US008319639B2

(12) United States Patent
Maharshak et al.

(10) Patent No.: US 8,319,639 B2
(45) Date of Patent: Nov. 27, 2012

(54) APPARATUS FOR KEEPING DOCUMENTS SUCH AS CARDS

(76) Inventors: Arie Maharshak, Shave-Zion (IL); Erez Maharshak, Shave-Zion (IL); Alon Maharshak, Shave-Zion (IL)

( * ) Notice: Subject to any disclaimer, the term of this patent is extended or adjusted under 35 U.S.C. 154(b) by 376 days.

(21) Appl. No.: 12/842,176

(22) Filed: Jul. 23, 2010

(65) Prior Publication Data

US 2011/0109457 A1 May 12, 2011

Related U.S. Application Data

(60) Provisional application No. 61/280,928, filed on Nov. 12, 2009.

(51) Int. Cl.
*G08B 13/14* (2006.01)

(52) U.S. Cl. ..... 340/568.7; 340/568.1; 340/571

(58) Field of Classification Search ..... 340/568.7, 340/568.1, 571, 522, 692, 570; 200/61.19; 281/2, 3.1, 5, 31, 15.1
See application file for complete search history.

(56) References Cited

U.S. PATENT DOCUMENTS

| | | | | |
|---|---|---|---|---|
| 4,652,865 | A | 3/1987 | Maharshak | |
| 5,034,724 | A * | 7/1991 | Tone | 340/571 |
| 5,373,283 | A | 12/1994 | Maharshak | |
| 5,892,444 | A * | 4/1999 | Wittmer et al. | 340/571 |
| 6,184,788 | B1 * | 2/2001 | Middlemiss et al. | 340/568.7 |
| 7,291,795 | B2 | 11/2007 | Maharshak | |

FOREIGN PATENT DOCUMENTS

| | | |
|---|---|---|
| IL | 68801 | 2/1986 |

* cited by examiner

*Primary Examiner* — Toan N Pham
(74) *Attorney, Agent, or Firm* — William J. Sapone; Coleman Sudol Sapone P.C.

(57) ABSTRACT

A cardholder in a book form, comprising a plurality of units each having two pockets, wherein each pocket is sized to hold a card, comprises an alarm circuit in its cover or in a special compartment. Conductive strips/traces on both sides of the walls of said pockets are configured such that if the cardholder is closed while at least one of the pockets is empty, said traces creates a closed electric path between terminals of said alarm circuit and the alarm is activated. However, if the book shaped cardholder is open such that an empty pocket is exposed—the alarm is deactivated.

22 Claims, 8 Drawing Sheets

APPARATUS FOR KEEPING DOCUMENTS SUCH AS CARDS

CROSS REFERENCE TO RELATED APPLICATION(S)

The present invention claims priority from provisional U.S. Patent application 61/280,928, filed Nov. 12, 2009.

FIELD OF THE INVENTION

The present invention relates to an alarmed products' keeper and more specifically to a cardholder having a plurality of pockets and equipped with circuitry to cause an alarm such as audible, visible or other desired signal to be emitted if a document/card that had been withdrawn has not been returned to its pocket.

BACKGROUND OF THE INVENTION

Modern life necessitates carrying and frequent use of variety of documents such as credit cards, identity cards, driving licenses, membership cards and the like. The term "card" will be used herein to describe such documents in general, although some, such as passports and the like may not be shaped like cards. Often, a person holds his important card in a card holder. A typical card holder composed of a series of separate, flat and transparent compartments or pockets which are interconnected either in book- or in strip-form as well as in the shape of a cigarette pack; the card holder is either fixedly connected to the inside of a wallet or is loosely carried in a lady's handbag. These card holders are used for carrying identity cards, credit cards, driver's licenses and similar cards of small size or in folded state, each in one of the transparent or partly transparent pockets, so as to be readily visible and withdrawable for use and/or presentation.

A person carrying a number of such cards is liable to forget returning a card into its appropriate pocket after having used it for payment or for presentation, or the person handed the card may forget to return it to the bearer. It is advantageous to remind the bearer that a specific card is missing from its compartment, by means of a visual or audible signal before the bearer leaves the location where the card was left.

Cardholders having alarm circuitry are described in Israeli Patent No. 68801, U.S. Pat. No. 4,652,865, and U.S. Pat. No. 5,373,283 as having a plurality of flexible pockets wherein conductors are fastened to the inside and outside the pockets and connected to an alarm circuit. Withdrawal of a card from a pocket, and closing the cardholder without returning said card, allows the conductors in that pocket to come into contact, thereby closing an electrical circuit and initiating the alarm circuit. If the electrical circuit is not interrupted, i.e., the card is not returned to the pocket, and the cardholder is closed, the alarm circuit causes an alarm to be emitted. The alarm reminds the owner to retrieve the card and place it back into the empty pocket of the cardholder, thereby opening the closed circuit and terminating the alarm.

U.S. Pat. No. 4,652,865 to Maharshak, titled "Card Holder", discloses a credit card holder which is composed of a series of transparent pockets and provided with an alarm system warning the owner that a card was not returned into its pocket. Each pocket is provided with two electric contact strips attached to the inside of the pocket walls which are separated by the credit card inside the pocket and are in contact whenever the card is withdrawn. The card holder contains a battery, a buzzer and a timer suitably connected to the contact strips. This timer serves to delay energizing of the buzzer for a time period in which the transaction can be reasonably accomplished, and sounds the alarm only then.

U.S. Pat. No. 5,373,283 to Maharshak, titled "Alarm system for a card holder", discloses a cardholder with an alarm which includes a control circuit to prevent operation of the alarm until the cardholder is folded up or closed. The control circuit is preferably an interrupted loop of conductive material on the exterior of one or more flexible pockets of the cardholder and a conductive member, which may be part of the loop, on an adjacent pocket or pockets which closes or bridges the gap in the interrupted loop when adjacent pockets are placed into overlying relationship such as by folding the cardholder.

U.S. Pat. No. 7,291,795 to Maharshak, et al., titled "Flexible printed circuits with many tiny holes", discloses switch or circuit board having a first conductive area on a first side of the board, a second conductive area on a second side of the board, several tiny holes running through the board from the first side to the second side, and a conductive material substantially filling the holes by capillary force, where the conductive material forms an electrical connection between the first conductive area and the second conductive area.

SUMMARY OF THE INVENTION

The present invention relates to an alarmed products' keeper and more specifically to a cardholder having a plurality of pockets and equipped with circuitry to cause an alarm such as audible, visible or other desired signal to be emitted if a document/card that had been withdrawn has not been returned to its pocket.

The invention relates to keeping and guarding flat products at large; however, in order to simplify the description, the word 'card' is used as a general term for all kind of flat products.

The present invention provides an alarm control system for a 'book form' cardholder composed of a plurality of units each having two pockets sharing a common wall. The 'two pockets' approach suggests an economical, compact, convenient and 'user friendly' concept and features:

(1) A very solid structure as one card usually keeps the pockets stretched, thus eases inserting a card back to its pocket by sliding it along the common high wall.

(2) Symmetric shape enabling the user to always see the cards' front face.

A cardholder in a book form, comprising a plurality of units each having two pockets, wherein each pocket is sized to hold a card comprises an alarm circuit in an attached pocket/sleeve/module or in its cover. Conductive traces/stripes on both sides of the walls of said pockets are configured such that if the cardholder is closed while at least one of the pockets is empty, said traces creates a closed electric path between terminals of said alarm circuit and the alarm is activated. However, if the book shaped cardholder is open such that an empty pocket is exposed the alarm is deactivated.

To this end, and in accordance with one aspect of the present invention, the alarm control includes two types of parallel electrical circuits, made of conductors on the unit's exterior walls and in series with the conductors within the pockets, and the alarm circuit. One kind of circuit is interrupted when two adjacent units are separated from each other to prevent completion of the connection to the alarm circuit. The second kind of circuit is interrupted by a gap on the unit's exterior wall, to prevent completion of the connection to the alarm circuit. The conductor on another wall such as the wall of another unit's exterior wall (or the end cover) is positioned to bridge the gap when the two units are placed in overlying relationship. Preferably, the two conductors are disposed on exterior walls of a pair of adjacent units. Thus, bridging the gap is accomplished, also, by two adjacent units coming into contact.

By virtue of the foregoing, only when the two units are in overlying relationship—the electrical circuit may be completed. Consequently, the alarm is disabled when the two units are separated one from the other.

According to an aspect of the current invention, a book form document holder with a document missing alarm is provided, the document holder comprising: a plurality of dual sided pocket units, wherein each unit comprises: a front wall; a central wall; and a rear wall; and wherein said substantially rectangular front, central and rear walls are jointed at the back edge and two other edges to form a front and a rear pockets with said central wall being a common wall separating the two pockets, wherein said pockets are open at a forth edge and are capable of holding a document inserted from said opening, wherein said plurality of said dual sided pocket units are connected together along their said back edges to form a book shaped structure such that a rear wall of one unit is adjacent to front wall of the next unit, wherein said book form structure is capable of being opened such that a front wall of a first unit is not in contact with the rear wall of the next unit, and is capable of being closed such that a front wall of a first unit makes contact with the rear wall of the next unit; an alarm circuit comprising: a battery; an alarm indicator; and an electronic circuitry having a positive and a negative terminal, wherein said electronic circuitry is capable of activating said alarm indicator when said positive and a negative terminal are electrically shorted; and a plurality of conductive traces, situated on said front, central and rear walls of said units, wherein at least some of said conductive traces are electrically connected to said positive and negative terminals, and wherein said conductive traces are capable of creating a short circuit between said positive and negative terminals when said book form structure is closed and at least one document is missing in at least one of said pockets, and said conductive traces are not creating a short circuit between said positive and negative terminals when said book form structure is closed and a document is present in each one of said pockets, and said conductive traces are not creating a short circuit between said positive and negative terminals when said book form structure is opened.

In some embodiments the alarm indicator is a buzzer.

In some embodiments the alarm indicator is selected from a group comprising: audio indicator; visual indicator and vibration indicator.

In some embodiments the book form document holder further comprises a rear cover adjacent to rear wall of last unit.

In some embodiments the book form document holder further comprises a front cover adjacent to front wall of first unit.

In some embodiments at least parts of the alarm circuit are integrated within at least one of: front or rear covers.

In some embodiments some of the front and rear walls of at least one unit are made of transparent material.

In some embodiments, when said when the book form structure is opened, the two documents: one in rear pocket of one unit and the other in front pocket of next unit, are exposed.

In some embodiments the book shaped structure is constructed such that it if said documents are inserted in said pockets such that their back sides face the central wall, than the two exposed documents always face the user.

In some embodiments at least one of: front walls or rear wall, has a shorter dimension in the direction normal to its open forth edge than the corresponding dimension of central wall of same unit.

In some embodiments the open forth edge is opposite to the back edge in at least one of said units.

In some embodiments the open forth edge is adjacent to the back edge in at least one of said units.

In some embodiments the documents are cards selected from cards such as: credit cards; membership cards; identity cards; driving licenses; bank cards; and blank cards used to ensure that each pocket has a document in it.

In some embodiments the documents are selected from documents such as: a passport; cash notes; and airplane tickets.

In some embodiments the front central and rear walls are made of flexible material.

In some embodiments the pockets are sized to substantially hold a standard size credit card.

In some embodiments the pockets are constructed such that when a first card is inserted in a first pocket in a unit, the second pocket in the same unit, if empty, is held straight as a result of the insertion of said first card, and ready to accept a second card.

In some embodiments the conductive traces comprise: a first trace situated on outer surface of the front wall and electrically connected to a first terminal of said electronic circuitry; a second trace, situated on outer surface of the front wall and separated from said first trace by a gap; a third trace, situated on inner surface of said front wall, and electrically connected to said second trace; a forth and fifth traces, situated on front and rear surfaces of central wall respectively, and electrically connected to the second terminal of said electronic circuitry; and a sixth and seventh traces, situated on inner and outer surfaces of rear wall respectively, and electrically connected to each other, In some embodiments the seventh trace on one unit makes electrical contact with both first and second traces on the next unit when said book form structure is closed.

In some embodiments the third and forth trace of same unit make electrical contact when said book form structure is closed and there is no document in the front pocket of said same unit.

In some embodiments the fifth and sixth trace of same unit make electrical contact when said book form structure is closed and there is no document in the rear pocket of said same unit.

Other objectives and advantages of the present invention shall become apparent from the following description of the invention.

The invention is capable of other embodiments or of being practiced or carried out in various ways. Also, it is to be understood that the phraseology and terminology employed herein is for the purpose of description and should not be regarded as limiting.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. In case of conflict, the patent specification, including definitions, will control. In addition, the materials, methods, and examples are illustrative only and not intended to be limiting.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention. The description taken with the drawings are apparent to those skilled in the art how the several forms of the invention may be embodied in practice.

In the drawings:

FIG. 3(*ii*) schematically shows the rear side of the front wall according to an exemplary embodiment of the current invention;

FIG. 4(*ii*) schematically shows the rear side of the central wall according to an exemplary embodiment of the current invention;

FIG. 5(*ii*) schematically shows the rear side of the rear wall according to an exemplary embodiment of the current invention;

DESCRIPTION OF THE PREFERRED EMBODIMENTS

Figure 1:
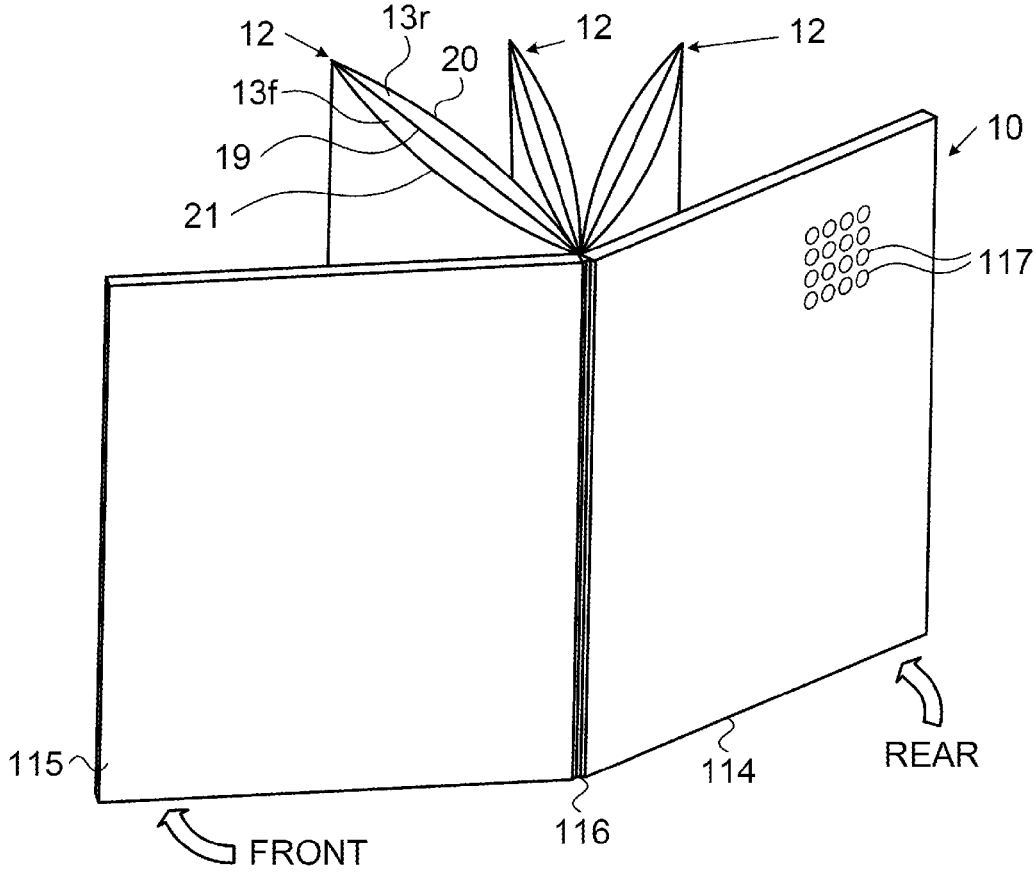
FIG. 1 schematically depicts an isometric back view of the assembled card holder with alarm according to an exemplary embodiment of the current invention.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

In discussion of the various figures described herein below, like numbers refer to like parts. For clarity, non-essential elements were omitted from some of the drawings. The drawings are generally not to scale.

FIG. 1 schematically depicts an isometric back view of the assembled card holder with alarm according to an exemplary embodiment of the current invention.

With reference to FIG. 1, an embodiment of a cardholder 10, in accordance with the principles of the present invention, is illustrated.

Cardholder 10, in 'book form', comprises several, flexible units 12 bounded in a cover comprising front cover 115 and rear cover 114 joined along common cover edge or seam 116. In the depicted embodiment, three such units 12 are seen; however, number of units may be smaller, and preferably larger than three. Each unit 12 is composed of two pockets 13 sharing a common central wall 19. Preferably, the common central wall 19 is higher in comparison to the two walls, 21 and 20, that form the unit 12. For drawing clarity, only two such pockets: front pocket 13*f* and rear pocket 13*r* of the plurality of pockets are marked in the figure. Units 12 are constructed from the three walls 19, 20 and 21. The walls are preferably made of plastic, preferably transparent material, which are joined by seams on three sided to form two pockets 13 per unit 12.

Rear cover 114 optionally comprising perforations 117 for transmitting audible alarm signal from an alarm electronic circuit within rear cover 114 (not visible in this figure).

In operation, the user first replaces blank cards—inserted by the manufacture in each of the pockets 13, upon finalizing the production—by his personal cards. Blank cards are still used if the number of cards the user wants to store and carry is smaller than the number of pockets. The cardholder then may be closed without activation of the alarm.

To use a card, the user open the book shaped cardholder 10 to the correct "page" such that the required card is in one of the two exposed pockets 13, and remove the required card.

After using the card, the user may insert the card back into the empty pocket and close the cardholder. However, if the user attempts to close the cardholder 10 while at least one of the pockets 13 is empty, the alarm is activated to remind the user that one of the cards is missing.

It should be noted that the alarm may be situated in a special compartment or in the front cover 115 or divided between the two covers 115 and 116. Perforations 117 on cover are optional and may be replaced or augmented by visual or vibrational alarm.

Figure 2:
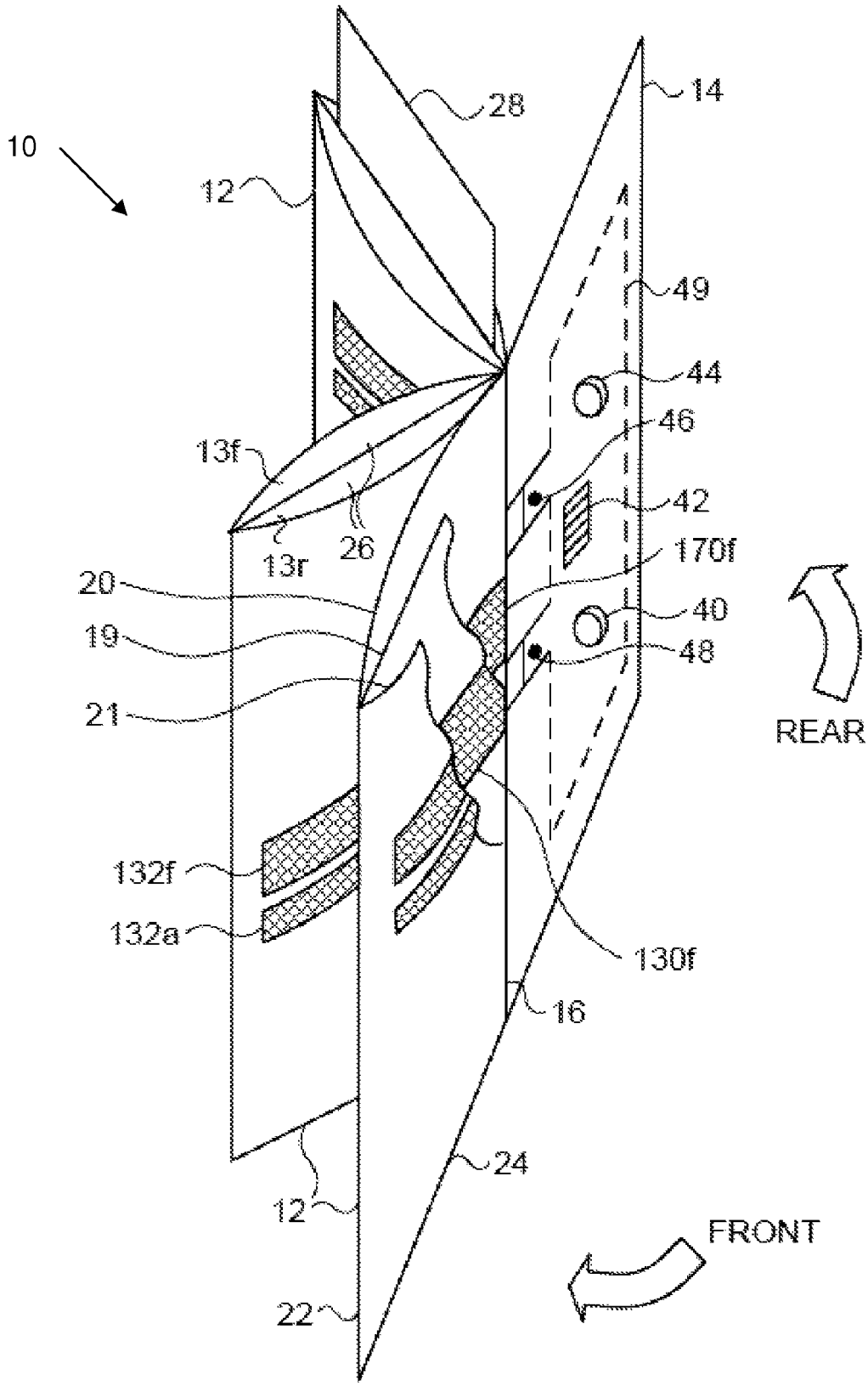
FIG. 2 schematically depicts an isometric cutoff view of the card holder with alarm, with cover removed, according to an exemplary embodiment of the current invention.

FIG. 2 schematically depicts an isometric cutoff view of the card holder with alarm, with cover removed, according to an exemplary embodiment of the current invention With reference to FIG. 2, an embodiment of a cardholder 10, in accordance with the principles of the present invention, is illustrated.

Cardholder 10, in 'book form', includes several, flexible units 12 and an electrical circuit board 14 all joined along common edge or seam 16. In the depicted embodiment, three such units 12 are seen; however, number of units may be smaller, and preferably larger than three.

Each unit 12 is composed of two pockets 13 sharing a common central wall 19. Preferably, the common central wall 19 is higher in comparison to the two walls 21 and 20, that form a unit. Units 12 are constructed by the three walls 19, 20 and 21. The walls are made of plastic, preferably transparent material, which are interconnected by inner seam 16, outer seam 22 and a bottom seam 24 to define the unit's pockets 13, and top two openings 26 for insertion and removal of a card 28.

Adjacent pairs of units 12 are interconnected at inner seam 16 to connect the units in the 'book form' fashion.

Alarm circuit 49 situated in electrical circuit board 14 comprises one or more electric cells or batteries 40, at least one integrated circuit such as chip 42 and buzzer or speaker 44.

Electrical circuit board 14 comprises two electrical terminals 46 and 48 which are in electrical contact with electrical conducting patterns on walls of units 12. When terminals 46 and 48 of alarm circuit 49 are electrically connected together, chip 42 activates buzzer 44 to sound an alarm.

Each pocket 12 is provided with conductive strips/traces on the walls of the pocket, to provide a direct electrical contact indicating the absence of a card when the cardholder is in closed position. However, when the cardholder is in open position, or when a card is inserted in each of all the pockets, the electrical path between terminals 46 and 48 is interrupted, and the alarm is deactivated.

The locations and operation of the conductor traces or strips on the walls of the pockets will be disclosed in the following figures.

Figure 3:
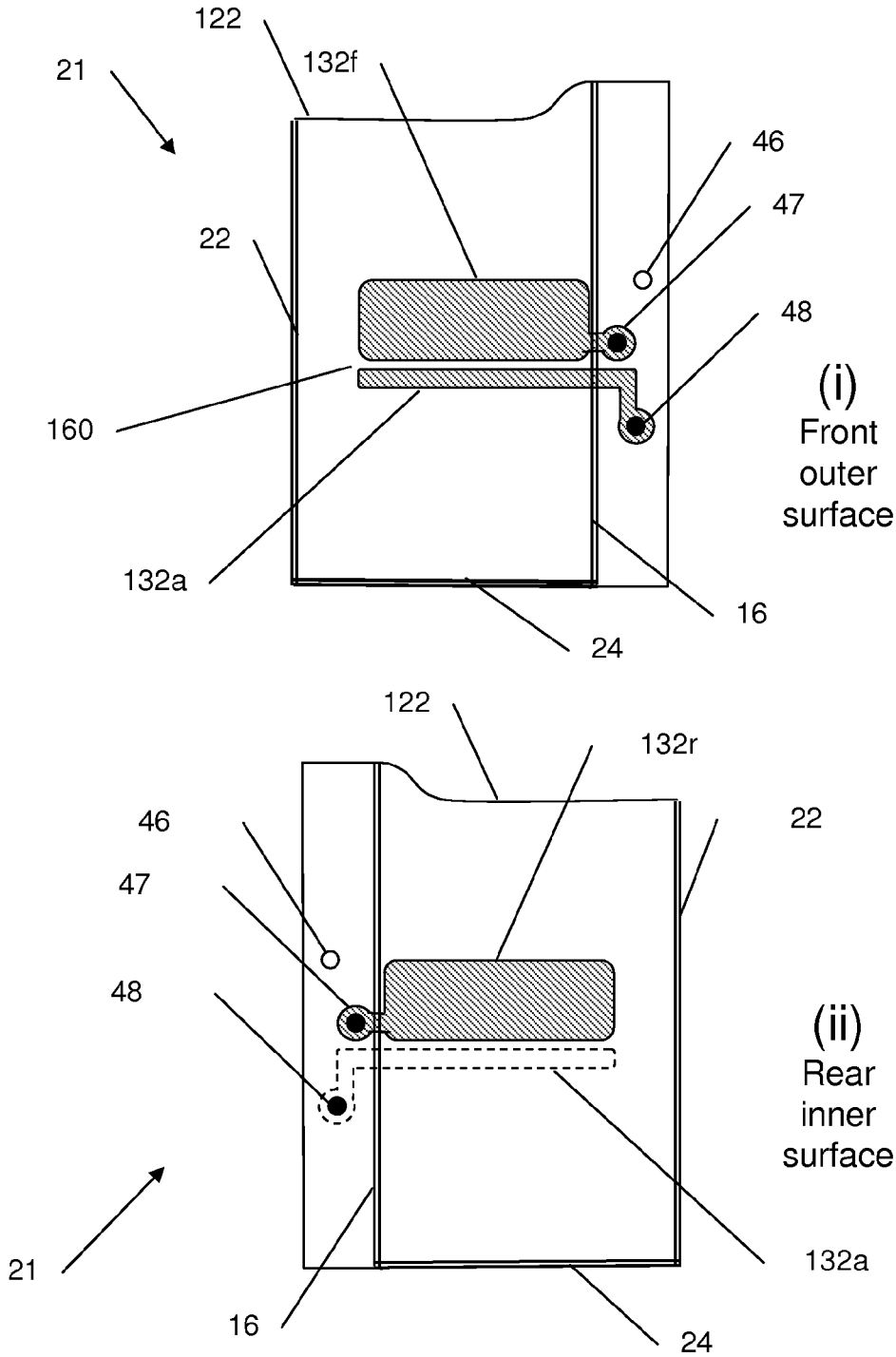
FIG. 3(*i*) schematically shows the front side of the front wall according to an exemplary embodiment of the current invention.
Figure 4:
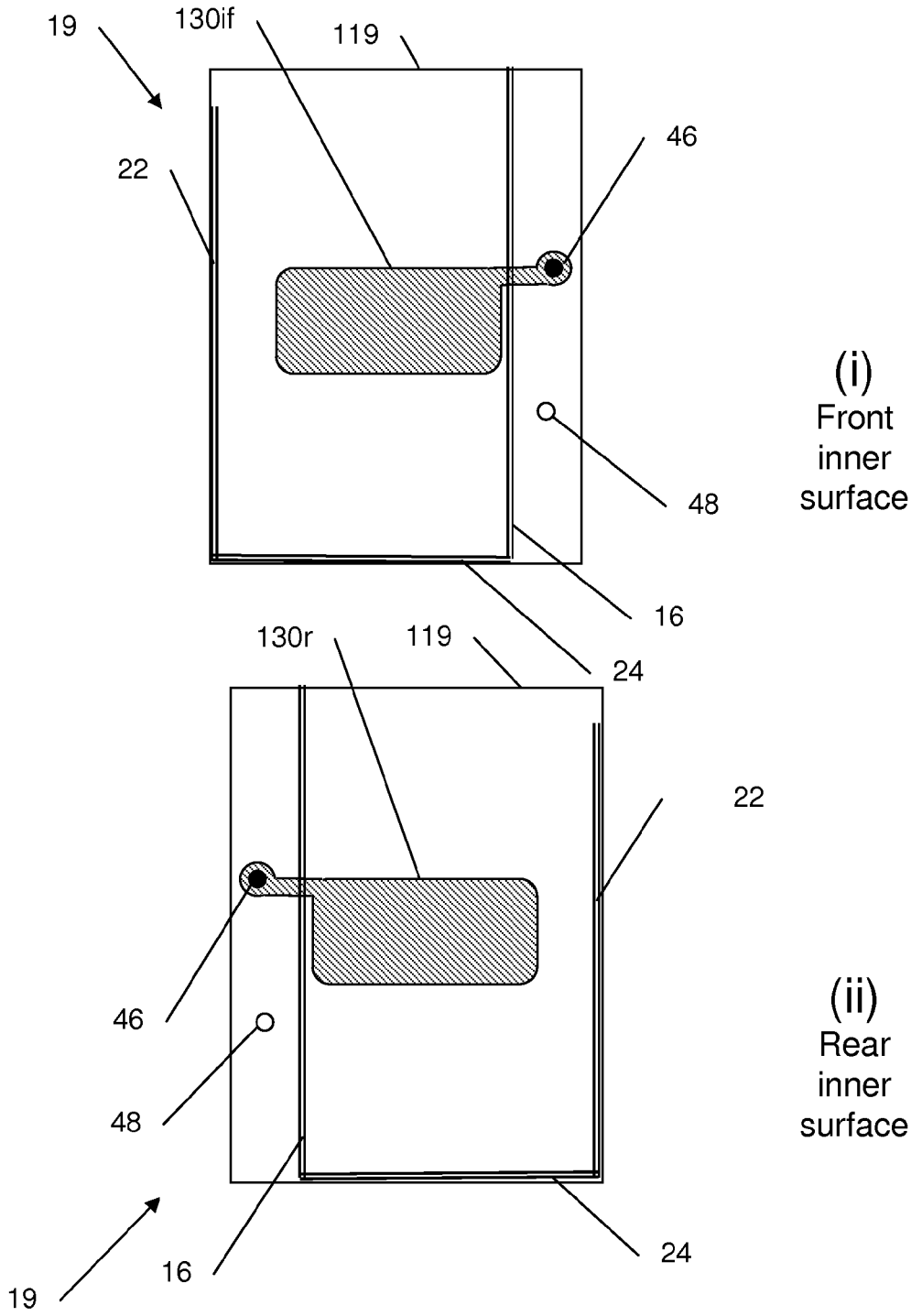
FIG. 4(*i*) schematically shows the front side of the central wall according to an exemplary embodiment of the current invention.
Figure 5:
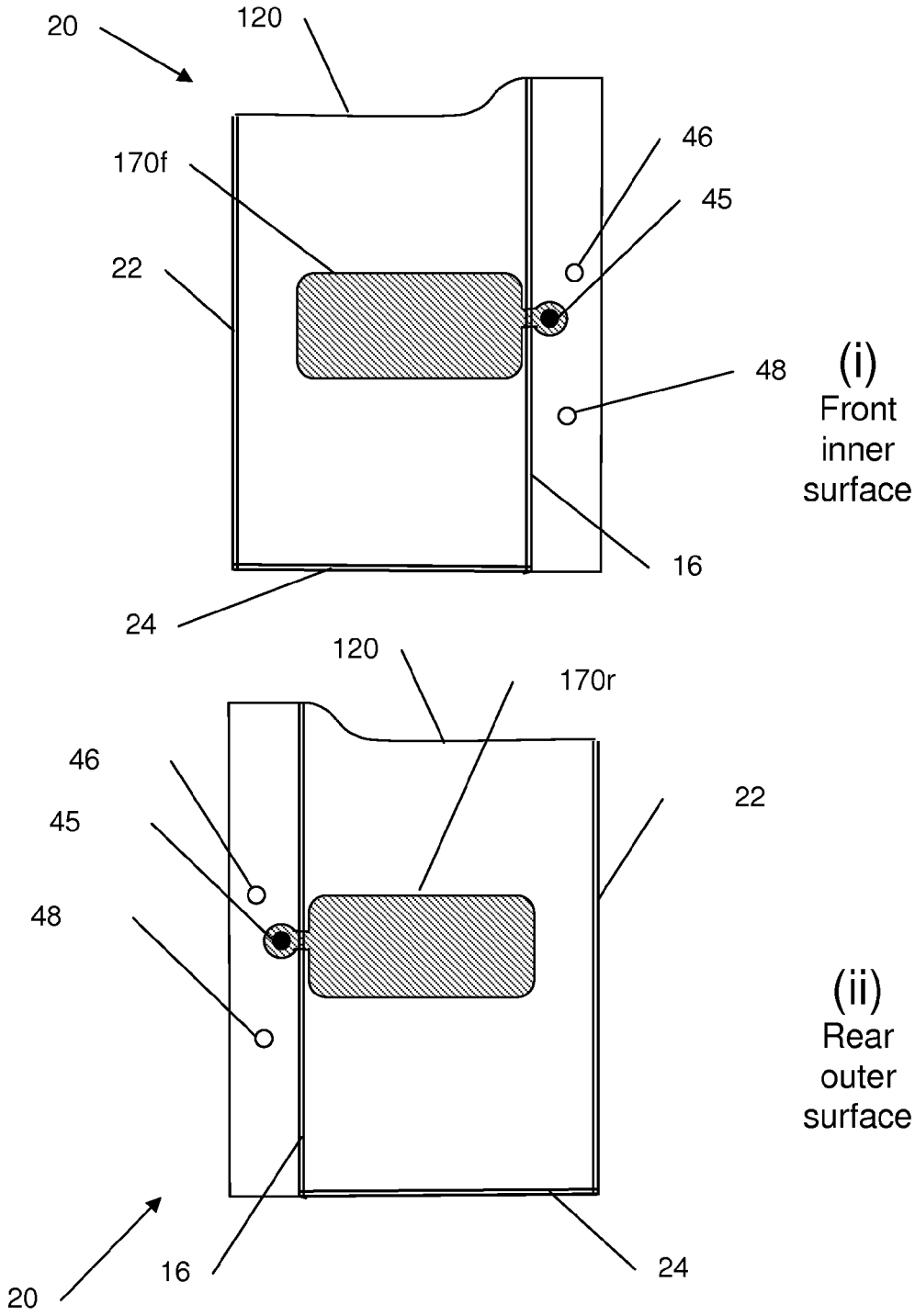
FIG. 5(*i*) schematically shows the front side of the rear wall according to an exemplary embodiment of the current invention.

FIGS. 3, 4 and 5, schematically and respectively depict the walls 21, 19, and 20 according to the exemplary embodiment of the current invention, showing the patterns of conductive strips on the surfaces of said walls.

FIG. 3(*i*) schematically shows front wall 21 from its front side which is on the outer side of unit 12. FIG. 3(*ii*) schematically shows front wall 21 from its rear side which is on the inner side of unit 12.

FIG. 4(*i*) schematically shows central wall 19 from its front side which is on the inner side of unit 12. FIG. 4(*ii*) schematically shows central wall 19 from its rear side which is on the inner side of unit 12.

FIG. 5(*i*) schematically shows rear wall 20 from its front side which is on the outer side of unit 12. FIG. 5(*ii*) schematically shows rear wall 20 from its rear side which is on the inner side of unit 12.

Mechanical Construction

Front wall 21 is connected to the central wall 19 of its unit in outer seam 22, and bottom seam 24. Front wall 21 is also connected to the central wall 19 of its unit on one side, and to rear wall 20 of the adjacent unit (unless it is in the extreme front unit) by inner seam 16.

Central wall 19 is connected on one side to the front wall 21 of its unit in outer, and on the other side to rear wall of its unit by outer seam 22, bottom seam 24 and inner seam 16.

Rear wall 20 is connected to the central wall 19 of its unit in outer seam 22, and bottom seam 24. Rear wall 20 is also connected to the central wall 19 of its unit on one side, and to front wall 21 of the adjacent unit (unless it is in the extreme rear unit) by inner seam 16.

Consequently, a plurality of units 12 are formed, each having two pockets defined by seams on three sides and an opening on the remaining upper side.

Figure 6A:
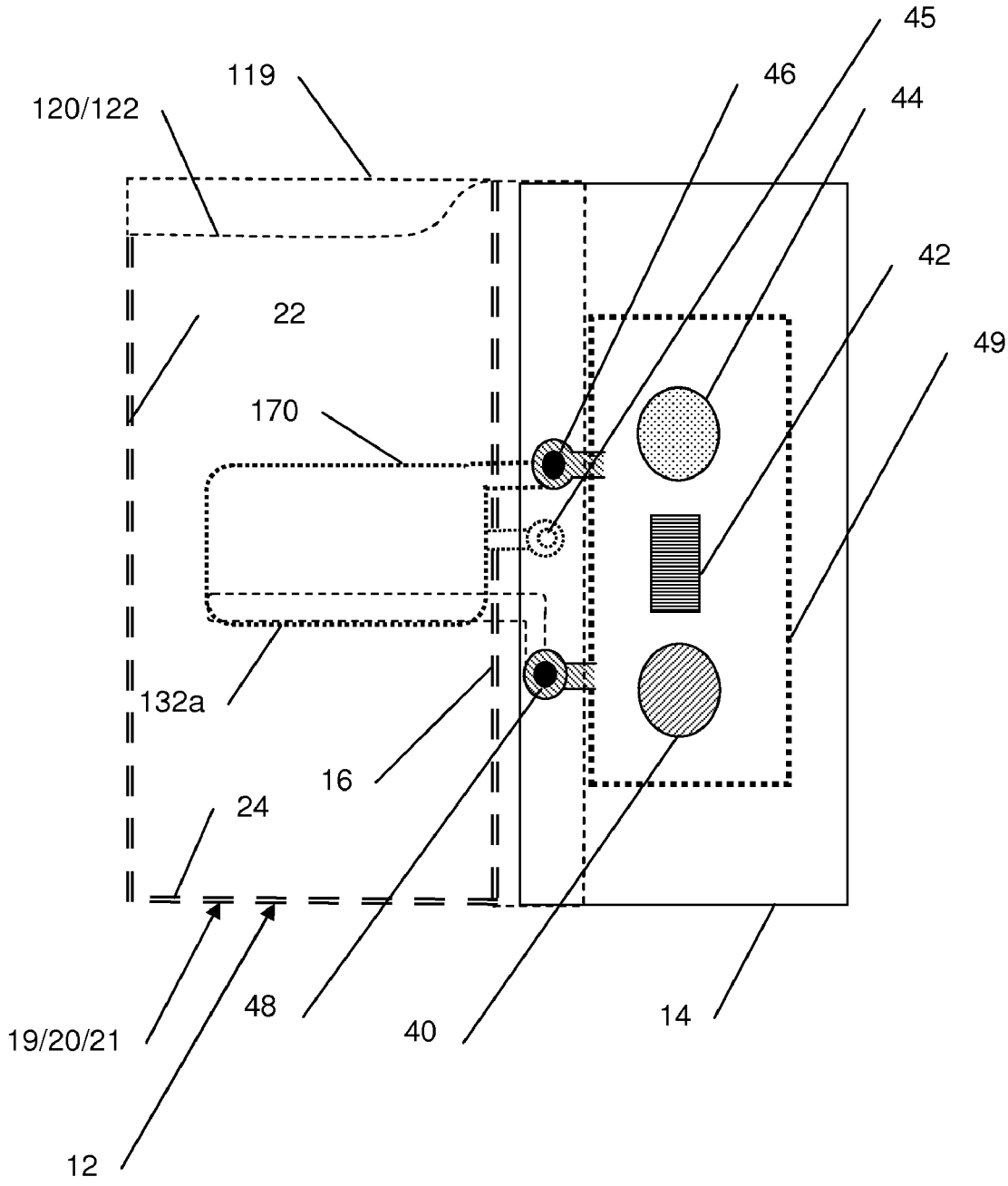
FIG. 6*a* schematically depicts the electrical connections of the alarm circuit situated in electrical circuit board according to an exemplary embodiment of the current invention.

Preferably, central wall 19 is higher 119 than front wall 21 and rear wall 20. Thus, upper edge 119 of wall 19 extends above the edges 122 and 120 of walls 21 and 20 respectively, as can be seen in FIG. 6*a*.

Electrical Traces and Connections.

As seen in FIG. 3(*i*) on the front surface of front wall 21 are two conductive traces 132*f* and 123*a*. The traces are isolated from each other, and are separated by gap 160.

Negative trace 132*a* is electrically connected to negative terminal 48 of alarm circuit 49. All negative traces 132*a* on all front walls 21 of all units 12 are electrically connected together using via holes in the walls.

Front floating conductive trace 132*f* on the front surface of front wall 21 is electrically connected to front floating conductive trace 132*r* on the rear surface of the same wall 21 by via 47. Front floating traces 132 on different front walls 21 of different units 12 are not electrically connected to each other. Traces 132 and vias 47 are so situated to avoid unintentional electrical contact with other traces and vias as would be apparent later.

As seen in FIG. 4(*ii*), on the front and rear surfaces of central wall 19 are positive conductive traces 130*f* and 130*r* respectively. Positive trace 130 is electrically connected to positive terminal 46 of alarm circuit 49. All positive traces 130 on all central walls 19 of all units 12 are electrically connected together using via holes in the walls.

On the front and rear surfaces of rear wall 20 are rear floating conductive trace 170*f* and 170*r* respectively. Rear floating trace 170*f* on the front surface of rear wall 20 is electrically connected to rear floating conductive trace 170*r* on the rear surface of the same wall 21 by via 45. Rear floating traces 170 on different front walls 20 of different units 12 are not electrically connected to each other. Traces 170 and vias 45 are situated to avoid unintentional electrical contact with other traces and vias as would be apparent later.

It should be noted that using the technology disclosed in U.S. Pat. No. 7,291,795, vias may be replaced by tiny holes running through the walls, along designed surfaces, and a conductive material substantially filling the holes by capillary force. Specifically, vias 47 and 45, connecting floating traces on opposing sides of the same wall may be replaced with the tiny holes technology running through the walls along the floating traces surface.

FIG. 6*a* schematically depicts the electrical connections of alarm circuit 49 situated in electrical circuit board 14.

Alarm circuit 49 comprises one or more electric cells or batteries 40, at least one integrated circuit such as chip 42 and buzzer or speaker 44.

Electrical circuit board 14 comprises positive electrical terminal 46 and negative terminal 48 which are in electrical contact with electrical conducting patterns 170 and 132*a* respectively on walls of units 12. Walls 19, and 21 and conductive traces on them are depicted in dashed line in this figure to indicate that they are piled one on top of the other. Electrical board 14 may be a rigid board such as printed circuit, a flexible printed circuit, or an extension of one of the walls, or may be part of the rear cover 114.

It should be noted that horizontal pockets are possible as well. In this case the pocket openings will offer a horizontal insert of cards.

Figure 6B:
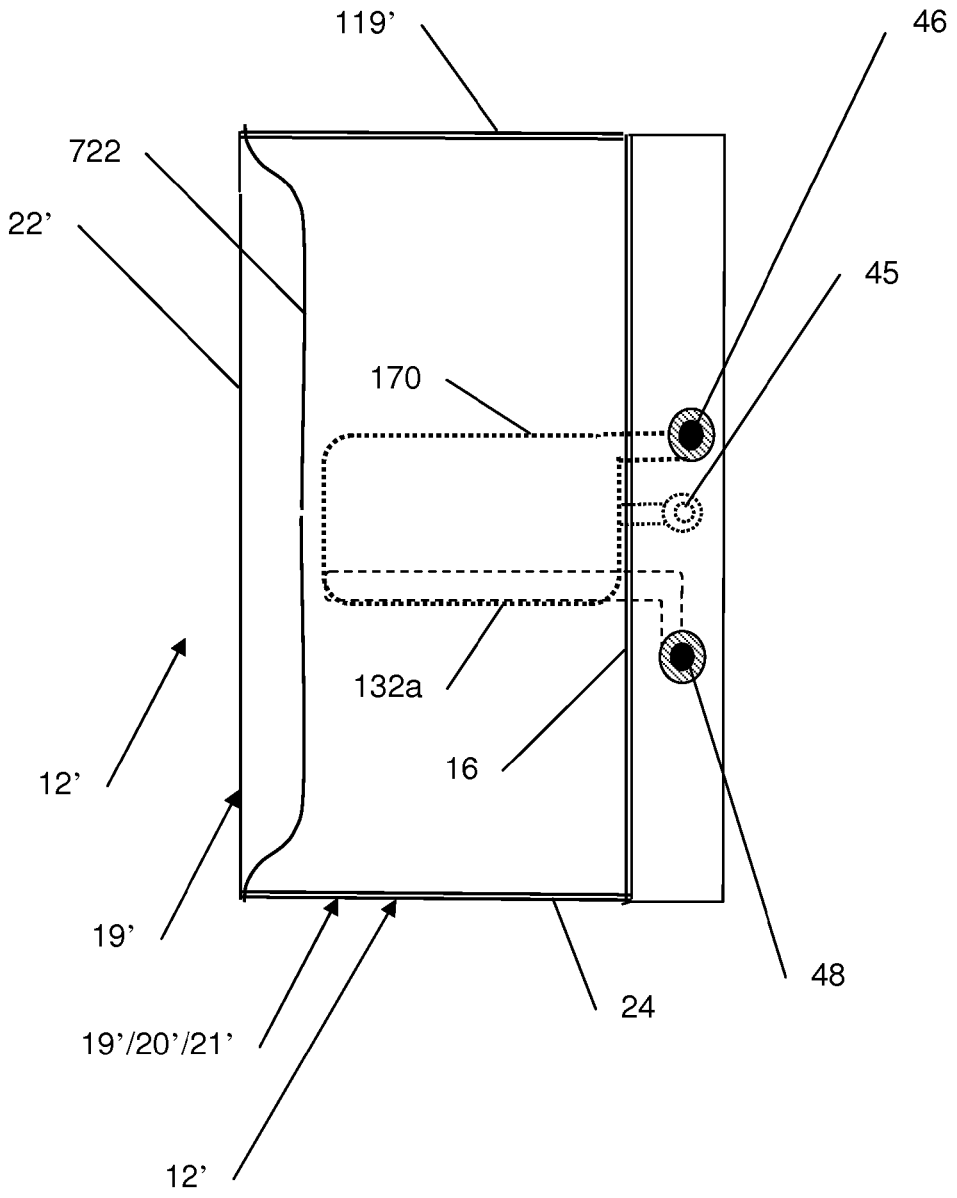
FIG. 6*b* schematically depicts horizontal pocket configuration according to another exemplary embodiment of the current invention; and, FIG. 7 schematically depicts an isometric front view of the assembled card holder with alarm according to an exemplary embodiment of the current invention.

This configuration is schematically depicted in FIG. 6*b*. FIG. 6*b* schematically depicts view of unit 12' having horizontal pockets configuration according to another exemplary embodiment of the current invention.

In this case, outer seam 22 is missing creating an opening to pockets formed by bottom seam 24; outer seam 22 and a new upper seam 119' joining upper edge 119, with upper edges 122 and 120.

In this case, walls 19', 20' and 21' are preferably of same height. Optionally, walls 20' and 21' may be narrower than wall 19'. Alternatively, optionally or additionally, walls 20' and 21' indentations 722 for easing insertion of cards into the horizontal pockets.

Figure 7:
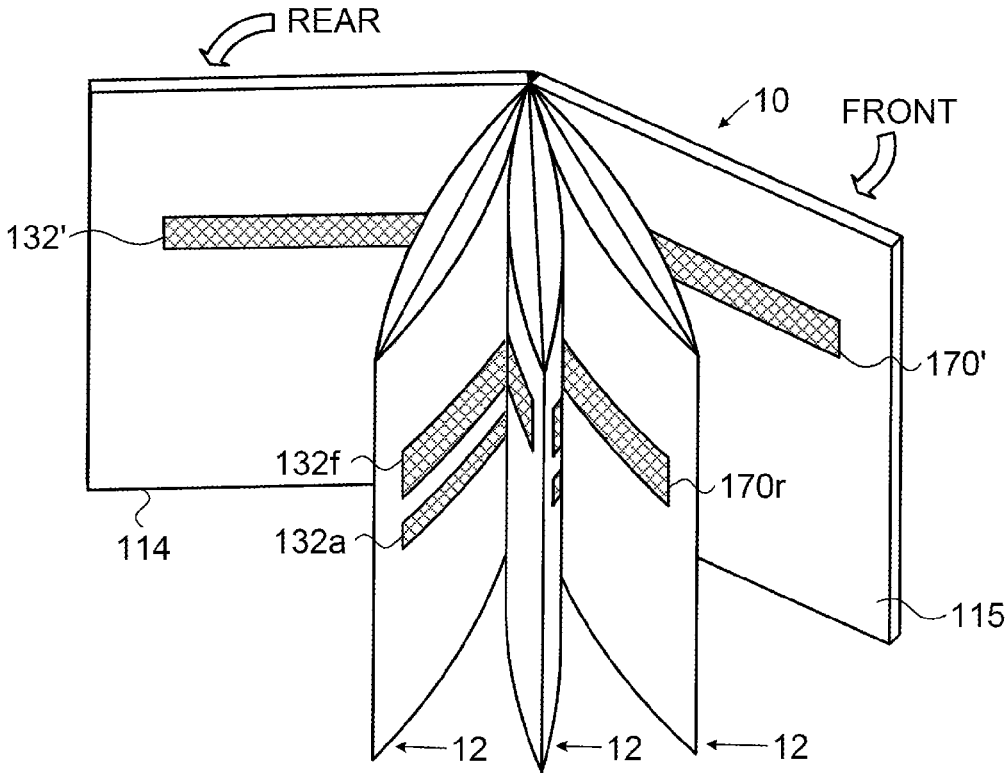

FIG. 7 schematically depicts an isometric front view of the assembled card holder with alarm according to an exemplary embodiment of the current invention.

In this view, some of the exposed traces such as traces 132*f*, 132*a* and 170*r* on outer surfaces of some of the units 12 may be seen.

Additionally, a rear cover negative trace 132', connected to negative terminal 48 is affixed to the inner surface of rear cover 114. Rear cover negative trace 132' may be printed for example on the back side of electrical board 49 or printed on the inner surface of rear cover 114.

Additionally, a rear cover floating trace 170', not electrically connected to any terminal or trace is affixed to the inner surface of front cover 115. Front floating trace 170' may be printed for example on the inner surface of front cover 115.

It should be noted that the front and rear cover could be completely eliminated. In this specific design, the electronic module will be inserted in a special compartment attached to the units along a seam and the first and last pockets will be eliminated, as well.

Operation of the Device.

As was stated before, if the user attempts to close the cardholder 10 while at least one of the pockets 13 is empty, the alarm is activated to remind the user that one of the cards is missing. In contrast, if all the pockets have cards in them, whether the cardholder is open or closed, the alarm is deactivated. Additionally, if the card holder is open and one or both cards are missing from the exposed pockets, the alarm is deactivated as well.

Unit 12 is asymmetric, thus the case of front pocket and rear pocket will be discussed separately.

Front Pocket 13*f*

Card 28 in front pocket 13*f* isolates positive trace 130*f* on central wall 19 from floating trace 130*r* on front wall 21. It is clear that as long as the card is in place, front pocket 13*f* cannot act as electrical path from positive terminal 46 to negative terminal 48.

If however, card 28 is missing from front pocket 13*f*, positive trace 130*f* on central wall 19 makes contact with floating trace 130*r* on front wall 21. If cardholder 10 is open to expose the empty pocket 13*f*, floating trace 132*f*, which is electrically connected to floating trace 132*r* cannot make contact with negative trace 132*a* on front face of front wall 21 due to gap 160. However, once the cardholder is closed, floating trace 170*r* (170' for the extreme front unit 12) make contact with both traces 123*a* and 132*f*, completing the electrical path between negative terminal 48 and positive terminal 46, thus activating the alarm.

The path in this case is: from terminal 46 to positive trace 130*f* on central wall 19 through the empty pocket 13*f* to floating trace 132*r* on front wall 21. From floating trace 132*r* on front wall 21 via via 47 to floating trace 132*f* on opposing side of same wall 21. From floating trace 132*f* to negative trace 132*a* on same wall 21 via floating trace 170*r* of the adjacent unit 12 (or 170' on cover 115).

Rear Pocket 13*r*

Card 28 in rear pocket 13*r* isolates positive trace 130*f* on central wall 19 from floating trace 130*f* on rear wall 20. It is clear that as long as the card is in place, rear pocket 13*r* cannot act as electrical path from positive terminal 46 to negative terminal 48.

If however, card 28 is missing from rear pocket 13*r*, positive trace 130*r* on central wall 19 makes contact with floating trace 170*f* on rear wall 20. If cardholder 10 is open to expose the empty pocket 13*r*, floating trace 170*r*, which is electrically connected to floating trace 170*f* cannot make contact with negative trace 132*a* on front face of front wall 21 of the adjacent unit 12 (negative trace 132' when empty rear pocket 13*r* is in the extreme rear unit). However, once the cardholder is closed, floating trace 170*r* make contact with negative trace 132*a* of the adjacent unit (132' for the extreme rear unit), completing the electrical path between negative terminal 48 and positive terminal 46, thus activating the alarm.

The path in this case is: from terminal 46 to positive trace 130*r* on central wall 19 through the empty pocket 13*r* to floating trace 170*f* on rear wall 20. From floating trace 170*r* on rear wall 20 via via 45 to floating trace 170*r* on opposing side of same wall 20. From floating trace 170*r* to negative trace 132*a* on front wall 21 of the adjacent unit (132' for the extreme rear unit).

While the present invention has been illustrated by the description of a specific embodiment, and while the embodiment have been described in considerable detail, it is not the intention of the applicant to restrict or in any way limit the scope of the appended claims to such detail. Additional advantages and modifications will readily appear to those skilled in the art.

For example, while conductor strips affixed to the front side of a wall were connected to the rear side of that wall—through a 'via hole'—in order to achieve electrical continuity between the two sides of the wall, other techniques of connection between wall's front conductor to wall's rear conductor could be employed, for example, by using the 'tiny holes running through the walls' technology disclosed in U.S. Pat. No. 7,291,795.

Another example relates to the alarm' description herein as being audible. It is stated that visual or other sort of alarm, such as vibrational could be employed.

Another example relates to the electrical paths offered in this application for closing the electrical circuits when two units are placed in overlying relationship. It is stated that other path, and configuration of conductive traces could be employed.

The walls are depicted as made of plastic, preferably transparent material. However, other materials may be used.

Conductors and traces may be silk printed, for example, on the plastic material using conductive ink made, for example, of carbon. However, other methods of forming traces may be used such as using conductive ink in a printer, etc.

Pockets and units are disclosed as being formed by seams, using, for example, high frequency welding techniques. However, other techniques such as applying heat and pressure may be used. Additionally, some parts such as walls depicted as separate pieces may be formed from one folded piece.

Adjacent pairs of units, and cover, may also be interconnected by seams to connect the units into the 'book form' fashion.

Alarm circuit, situated in the end cover, depicted as comprising one or more electric cells or batteries such as Lithium, a chip 42 aimed to create a signal and buzzer or speaker 44 to emit the signal. However, buzzer 44 may be capable of sounding the alarm without the use of chip 42. Additionally, or alternatively, a visual alarm such as LED or vibrational alarm may be used.

In some optional embodiments of the invention, the book form structure is used for promotional purposes. In these cases, a logo or advertisement may be printed or embossed on the covers or the walls. Optionally, the book form structure, together with alarm circuit may be sold to secondary manufacturer that fits it with covers and/or advertisement markings.

In some optional embodiments a card with a printed logo is inserted to at least one of the pockets and is permanently held therein, for example by welding the open edge, or using glue. Preferably, transparent wall are used so that the logo is visible. Preferably, the rear pocket of the rear unit, or the front pocket of the front unit, or both are used. Thus, the printed message may be seen when the book form structure is closed. In this case, the permanently filled pocket may be used as a cover. In this case, conductive traces related to detecting document in the permanently filled pocket or pockets are unnecessary and may be omitted.

In some optional embodiment, the alarm circuit is located in one of the rear pocket of the rear unit, or the front pocket of the front unit, or divided between both.

The invention in its broader aspects is therefore not limited to the specific details, representative apparatus and method and illustrative examples shown and described. Accordingly, departures may be made from such details without departing from the scope or spirit of applicant's general inventive concept.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub combination.

The invention claimed is:

1. A book form document holder with document missing alarm comprising:

a plurality of dual sided pocket units, each unit comprising:

a front wall;

a central wall; and a rear wall;

wherein said front, central and rear walls are jointed at a back edge and two other edges to form a front and a rear pockets with said central wall being a common wall separating the two pockets, wherein said pockets are open at a fourth edge and are capable of holding a document inserted from said opening, wherein said plurality of said dual sided pocket units are connected together along their said back edges to form a book shaped structure such that a rear wall of one unit is adjacent to front wall of the next unit, wherein said book form structure is capable of being opened such that a front wall of a first unit is not in contact with the rear wall of the next unit, and is capable of being closed such that a front wall of a first unit makes contact with the rear wall of the next unit;

an alarm circuit comprising:

a battery;

an alarm indicator; and an electronic circuitry having a positive and a negative terminal, wherein said electronic circuitry is capable of activating said alarm indicator when said positive and negative terminals are electrically shorted; and a plurality of conductive traces, situated on said front, central and rear walls of said units, wherein at least some of said conductive traces are electrically connected to said positive and negative terminals, and wherein said conductive traces are capable of creating a short circuit between said positive and negative terminals when said book form structure is closed and at least one document is missing in at least one of said pockets, and said conductive traces are not creating a short circuit between said positive and negative terminals when said book form structure is closed and a document is present in each one of said pockets, and said conductive traces are not creating a short circuit between said positive and negative terminals when said book form structure is opened.

2. The book form document holder of claim 1 wherein said alarm indicator is a buzzer.

3. The book form document holder of claim 1 wherein said alarm indicator is selected from a group comprising: audio indicator; visual indicator and vibration indicator.

4. The book form document holder of claim 1 and further comprising a rear cover adjacent to rear wall of last unit.

5. The book form document holder of claim 4 wherein at least parts of said alarm circuit are integrated within at least one of said front or rear covers.

6. The book form document holder of claim 1 and further comprising a front cover adjacent to front wall of first unit.

7. The book form document holder of claim 6 wherein at least parts of said alarm circuit are integrated within at least one of said front or rear covers.

8. The book form document holder of claim 1 wherein at least front and rear walls of at least one unit are made of transparent material.

9. The book form document holder of claim 1 wherein when said book form structure is opened, the two documents, one in rear pocket of one unit and the other in front pocket of next unit are exposed.

10. The book form document holder of claim 9 wherein said book shaped structure is constructed such that it if said documents are inserted in said pockets such that their back sides face the central wall, than the two exposed documents always face a user.

11. The book form document holder of claim 1 wherein at least one of said front walls or rear wall has a shorter dimension in a direction normal to its open forth edge than the corresponding dimension of central wall of same unit.

12. The book form document holder of claim 1 wherein the open forth edge is opposite to the back edge in at least one of said units.

13. The book form document holder of claim 1 wherein the open forth edge is adjacent to the back edge in at least one of said units.

14. The book form document holder of claim 1 wherein said documents are cards selected from the group consisting of credit cards; membership cards; identity cards; driving licenses; bank cards; and blank cards used to ensure that each pocket has a document in it.

15. The book form document holder of claim 1 wherein said documents are selected from the group consisting of a passport; cash notes; and airplane tickets.

16. The book form document holder of claim 1 wherein said front central and rear walls are made of flexible material.

17. The book form document holder of claim 16 wherein said pockets are sized to substantially hold a standard size credit card.

18. The book form document holder of claim 17 wherein said pockets are constructed such that when a first card is inserted in the front pocket in a unit, the rear pocket in the same unit, if empty, is held straight as a result of the insertion of said first card, and ready to accept a second card.

19. The book form document holder of claim 1 wherein said conductive traces comprise:

a first trace situated on outer surface of the front wall and electrically connected to the positive terminal of said electronic circuitry;

a second trace, situated on outer surface of the front wall and separated from said first trace by a gap;

a third trace, situated on inner surface of said front wall, and electrically connected to said second trace;

a fourth and fifth traces, situated on front and rear surfaces of central wall respectively, and electrically connected to the negative terminal of said electronic circuitry; and a sixth and seventh traces, situated on inner and outer surfaces of rear wall respectively, and electrically connected to each other.

20. The book form document holder of claim 19 wherein the seventh trace on one unit makes electrical contact with both first and second traces on the next unit when said book form structure is closed.

21. The book form document holder of claim 19 wherein the third and forth trace of same unit make electrical contact when said book form structure is closed and there is no document in the front pocket of said same unit.

22. The book form document holder of claim 19 wherein the fifth and sixth trace of same unit make electrical contact when said book form structure is closed and there is no document in the rear pocket of said same unit.

* * * * *